US007280340B2

(12) United States Patent
Smith et al.

(10) Patent No.: US 7,280,340 B2
(45) Date of Patent: Oct. 9, 2007

(54) SYSTEMS AND METHODS FOR IMMOBILIZATION

(75) Inventors: Patrick W. Smith, Paradise Valley, AZ (US); Magne H. Nerheim, Scottsdale, AZ (US)

(73) Assignee: TASER International, Inc., Scottsdale, AZ (US)

( * ) Notice: Subject to any disclaimer, the term of this patent is extended or adjusted under 35 U.S.C. 154(b) by 307 days.

(21) Appl. No.: 10/750,374

(22) Filed: Dec. 31, 2003

(65) Prior Publication Data

US 2005/0115387 A1 Jun. 2, 2005

Related U.S. Application Data

(60) Provisional application No. 60/509,480, filed on Oct. 8, 2003, provisional application No. 60/509,577, filed on Oct. 7, 2003.

(51) Int. Cl.
*A61D 3/00* (2006.01)

(52) U.S. Cl. ..... 361/232; 361/235; 102/502

(58) Field of Classification Search ..... 361/232, 361/235; 102/502

See application file for complete search history.

(56) References Cited

U.S. PATENT DOCUMENTS 3,376,470 A 4/1968 Stone et al.
5,698,815 A 12/1997 Ragner
5,962,806 A * 10/1999 Coakley et al. ..... 102/502
6,204,476 B1 3/2001 Reynolds et al.
6,880,466 B2 * 4/2005 Carman ..... 102/502
6,999,295 B2 * 2/2006 Watkins et al. ..... 361/232

OTHER PUBLICATIONS

Stun Guns, An Independent Report, 1994, T'Prina technology.*
Alon, Gad, Optimization of Pulse Duration and Pulse Charge Durin gTransutaneous Electrical Nerve Stimulation, The Australian Journal of Physiothereapy, Dec. 1983, pp. 195 to 201, vol. 29 No. 6, Australia.

* cited by examiner

*Primary Examiner*—Michael Sherry
*Assistant Examiner*—Zeev Kitov
(74) *Attorney, Agent, or Firm*—William R. Bachand

(57) ABSTRACT

Systems and methods for immobilizing a target such as a human or animal with a stimulus signal coupled to the target via electrodes provide the stimulus signal in accordance with a strike stage, a hold stage, and a rest stage. Systems include a launch device and separate projectile, where the projectile includes a battery, a waveform generator, and electrodes. The strike stage and hold stage may include pulses at a pulse repetition rate, for example, from 10 to 20 pulses per second, each pulse delivering a predetermined amount of charge, for example, about 100 microcoulombs at less than about 500 volts peak. The hold stage may continue immobilization at a lesser expenditure of energy compared to the strike stage. Because the strike stage and hold stage may immobilize by interfering with skeletal muscle control by the target's nervous system, a rest stage may allow the target to take a breath.

32 Claims, 4 Drawing Sheets

| | STIMULUS SIGNAL | | | | |
|---|---|---|---|---|---|
| DESCRIPTION | PATH MANAGEMENT | | TARGET MANAGEMENT | | |
| STAGE | PATH FORMATION | PATH TESTING | STRIKE | HOLD | REST |
| SHAPE | A | A | A B | A B | |
| DURATION | 10–100 μSEC | 10 μSEC | 50 μSEC | 50 μSEC | 2 SEC |
| AMPLITUDE | A=50KV POWER = 0.75–3.0 JOULES | A=450KV | A=SPV B@100 μC | A=SPV B@100 μC | 0 |
| REPETITION RATE | N/A | 1 TO 3 PULSES/MIN. | 20/SEC | 10/SEC | 0 |
| TYPICAL DURATION OF STAGE | 0.0005 SEC | 0.001 SEC | 2 SEC | 28 SEC | 2 SEC |

FIG. 3

SYSTEMS AND METHODS FOR IMMOBILIZATION

CROSS-REFERENCE TO RELATED APPLICATIONS

This application is a continuation in part of and claims priority to U.S. application entitled "Systems and Methods Using an Electrified Projectile" by Patrick W. Smith, et al., filed Nov. 13, 2003, incorporated herein by reference; and claims priority under 35 U.S.C. .sctn. 119(e) to now abandoned U.S. application Ser. No. 60/509,577 filed on Oct. 7, 2003 by Patrick Smith et al., incorporated herein by reference; and to now abandoned U.S. application Ser. No. 60/509,480 filed on Oct. 8, 2003 by Patrick Smith et al., incorporated herein by reference.

GOVERNMENT LICENSE RIGHTS

The present invention may have been, in part, derived in connection with U.S. Government sponsored research. Accordingly, the U.S. Government has a paid-up license in this invention and the right in limited circumstances to require the patent owner to license others on reasonable terms as provided for by the terms of contract No. N00014-02-C-0059 awarded by the Office of Naval Research.

FIELD OF THE INVENTION

Embodiments of the present invention generally relate to systems and methods for reducing mobility in a person or animal.

BACKGROUND OF THE INVENTION

Weapons that deliver electrified projectiles have been used for self defense and law enforcement. These weapons typically deliver a stimulus signal through a target where the target is a human being or an animal. One conventional class of such weapons includes conducted energy weapons of the type described in U.S. Pat. Nos. 3,803,463 and 4,253,132 to Cover. These weapons typically fire projectiles toward the target so that electrodes carried by the projectile make contact with the target, completing a circuit that delivers a stimulus signal via tether wires through the electrodes and through the target. Other conventional conducted energy weapons omit the projectiles and deliver a stimulus signal through electrodes placed in contact with the target when the target is in close proximity to the weapon.

The stimulus signal may include a series of relatively high voltage pulses known to cause pain in the target. At the time that the stimulus signal is delivered, a high impedance gap (e.g., air or clothing) may exist between electrodes and the target's conductive tissue. Conventional stimulus signals include a relatively high voltage (e.g., about 50,000 volts) signal to ionize a pathway across such a gap of up to 2 inches. Consequently, the stimulus signal may be conducted through the target's tissue without penetration of the projectile into the tissue.

In some conventional conducted energy weapons, a relatively higher energy waveform has been used. This waveform was developed from studies using anesthetized pigs to measure the muscular response of a mammalian subject to an energy weapon's stimulation. Devices using the higher energy waveform are called Electro-Muscular Disruption (EMD) devices and are of the type generally described in U.S. patent application Ser. No. 10/016,082 to Patrick Smith, filed Dec. 12, 2001, incorporated herein by this reference. An EMD waveform applied to an animal's skeletal muscle typically causes that skeletal muscle to violently contract. The EMD waveform apparently overrides the target's nervous system's muscular control, causing involuntary lockup of the skeletal muscle, and may result in complete immobilization of the target.

Unfortunately, the relatively higher energy EMD waveform is generally produced from a higher power capability energy source. In one implementation, a handheld launch device includes 8 AA size (1.5 volt nominal) batteries, a large capacity capacitor, and transformers to generate a 26-watt EMD output in a tethered projectile.

A two pulse waveform of the type described in U.S. patent application Ser. No. 10/447,447 to Magne Nerheim filed Feb. 11, 2003, provides a relatively high voltage, lower amperage pulse (to form an arc through a gap as discussed above) followed by a relatively low voltage, higher amperage pulse (to stimulate the target). Effects on skeletal muscles may be achieved with 80% less power than used for the EMD waveform discussed above.

There exists a significant need for a more effective stimulus signal for use in conducted energy weapons to immobilize a human target without lasting injury or death. In the decade preceding this application, annually over 30,000 people died of bullet wounds in the United States. Further, thousands of police officers are injured as a result of confrontations with non compliant members of the general public each year. Even larger numbers of these non-compliant subjects are injured in the process of being taken into police custody. Without systems and methods for delivering more effective stimulus signals, further improvements in cost, reliability, range, and effectiveness cannot be realized for conducted energy weapons. Applications for conducted energy weapons will remain limited, hampering law enforcement and failing to provide increased self defense to individuals.

SUMMARY OF THE INVENTION

A method, according to various aspects of the present invention, for immobilizing a target with a stimulus signal coupled to the target via electrodes includes, in any order, (a) providing the stimulus signal in accordance with a strike stage; (b) providing the stimulus signal in accordance with a hold stage; and (c) providing the stimulus signal in accordance with a rest stage.

A circuit for immobilizing a target, according to various aspects of the present invention, includes a charge storage circuit and a processor circuit. The processor circuit obtains a first value, couples the charge storage circuit to the target for discharging the charge storage circuit and delivering a charge into the target, obtains a second value, and limits discharging after delivery of a predetermined charge is indicated in accordance with the first value and the second value. The first value corresponds to an initial charge stored in the charge storage circuit. The second value corresponds to a current quantity of charge stored in the charge storage circuit.

Another method, according to various aspects of the present invention, for immobilizing a target with a stimulus signal coupled to the target via electrodes, includes in any order: (a) providing across the electrodes a pulse, wherein: each pulse has a peak voltage less than an ionization potential; and each pulse delivers a charge in a range of about 20 microcoulombs to about 300 microcoulombs; and (b) repeating the pulse to form a series of pulses having a pulse repetition rate in a range of about 5 pulses per second to about 30 pulses per second.

A circuit, according to various aspects of the present invention, for immobilizing a target includes a charge storage circuit and a processor circuit. The processor circuit couples the charge storage circuit to the target for discharging a stored charge through the target beginning at a first voltage magnitude less than an ionization potential; and limits discharging after a voltage monitored by the processor circuit crosses a threshold voltage magnitude. The threshold voltage magnitude is in accordance with delivery of a predetermined charge for continuous skeletal muscle contraction.

Another circuit, according to various aspects of the present invention, for immobilizing a target includes a charge storage circuit and a processor circuit. The processor circuit couples the charge storage circuit to the target for discharging the stored charge through the target beginning at a first voltage magnitude less than an ionization potential; and limits discharging after a time has lapsed. The time is in accordance with delivery of a predetermined charge for continuous skeletal muscle contraction.

Circuits and methods according to various aspects of the present invention solve the problems discussed above at least in part by more effectively immobilizing a target, by reducing the risk of serious injury or death, and/or by immobilizing for a period of time with an expenditure of energy less than systems using techniques of the prior art.

BRIEF DESCRIPTION OF THE DRAWING

Embodiments of the present invention will now be further described with reference to the drawing, wherein like designations denote like elements, and:

FIG. 3 is a timing diagram for a stimulus signal provided by the immobilization device of FIG. 2.

DETAILED DESCRIPTION OF THE PREFERRED EMBODIMENTS

Figure 1:
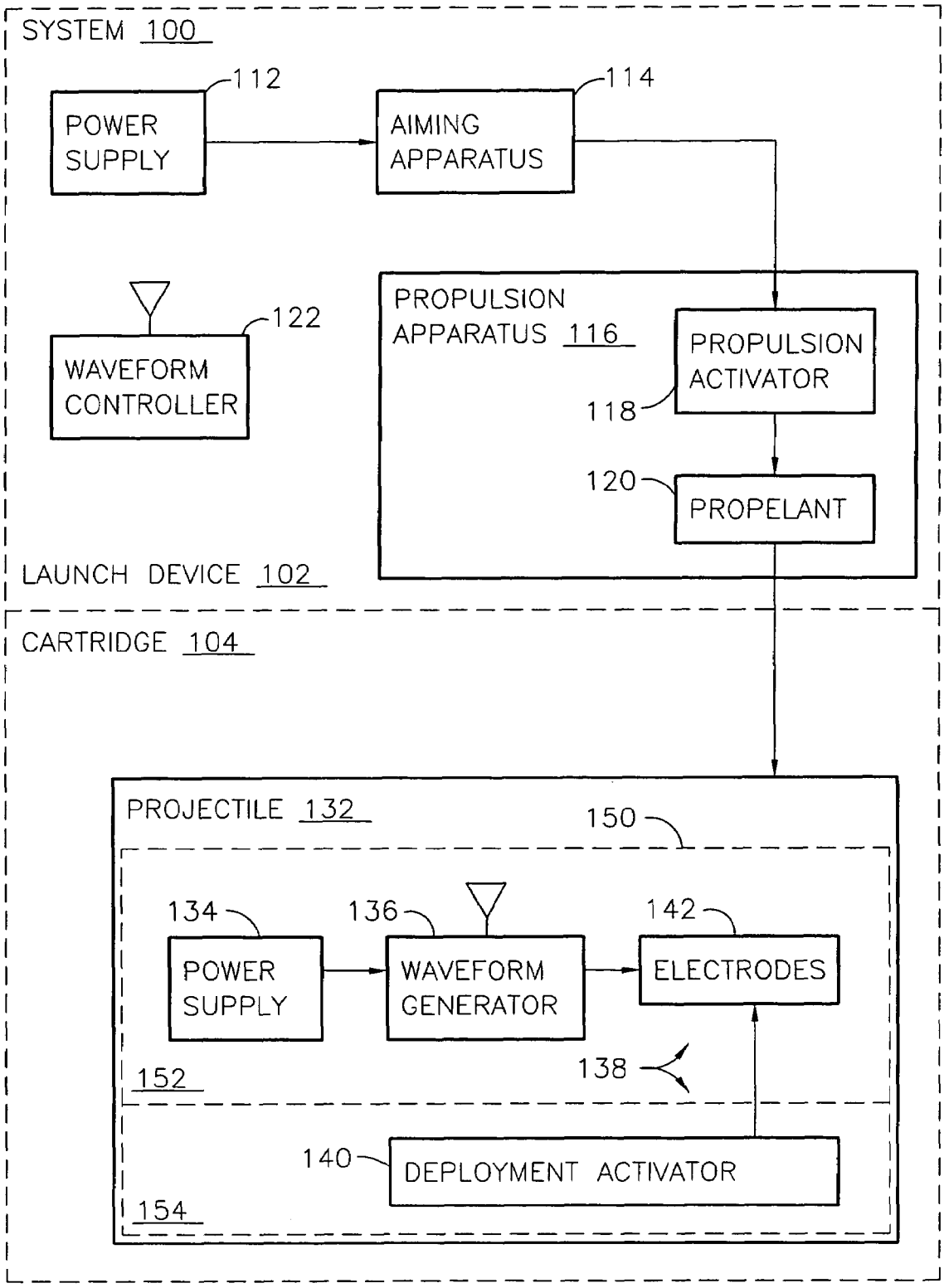
FIG. 1 is a functional block diagram of a system that uses a stimulus signal for immobilization according to various aspects of the present invention.
Figure 2:
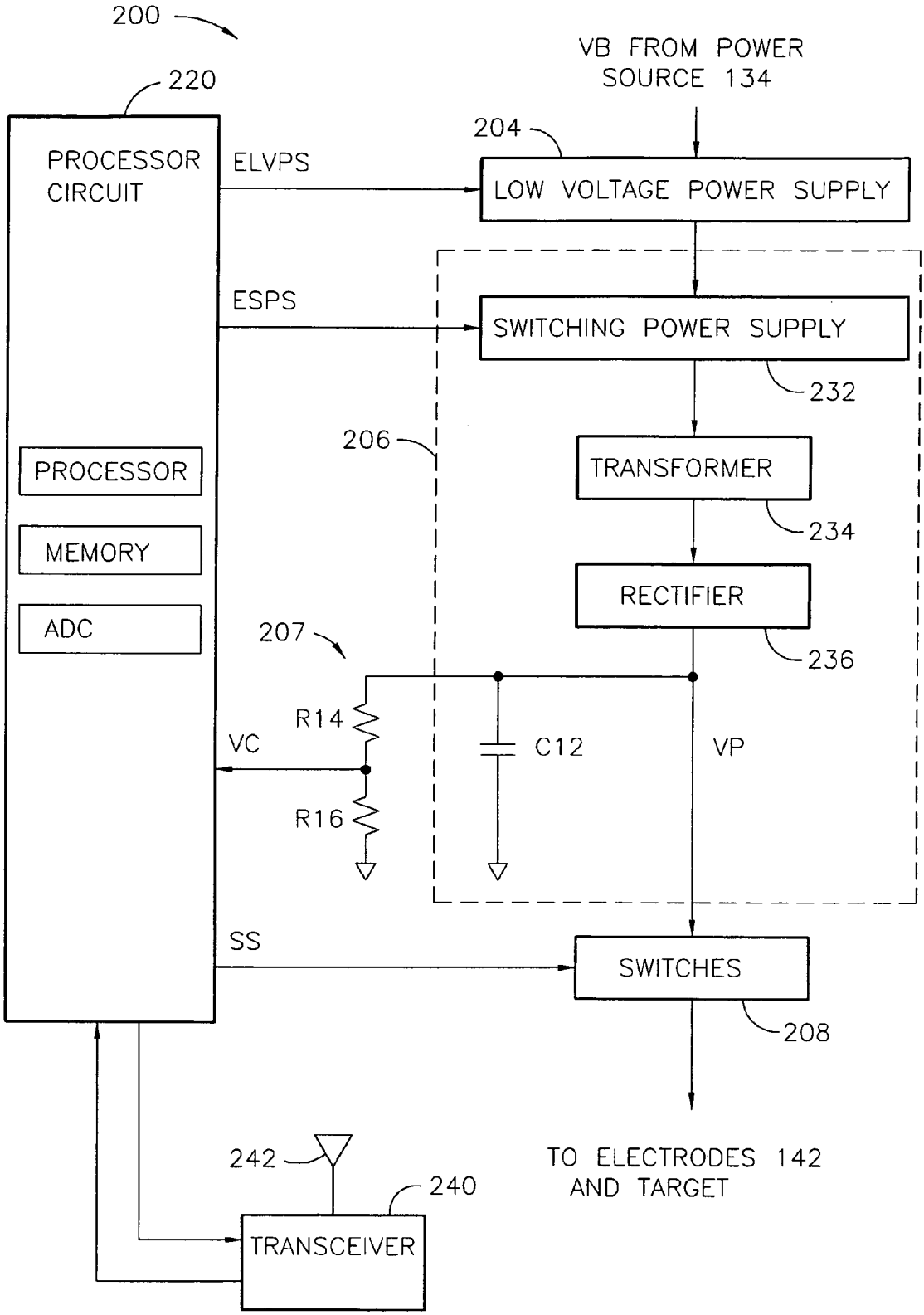
FIG. 2 is a functional block diagram of an immobilization device used in the system of FIG. 1.

A system according to various aspects of the present invention delivers a stimulus signal to an animal to immobilize the animal. Immobilization is suitably temporary, for example, to remove the animal from danger or to thwart actions by the animal such as for applying more permanent restraints on mobility. Electrodes may come into contact with the animal by the animal's own action (e.g., motion of the animal toward an electrode), by propelling the electrode toward the animal (e.g., electrodes being part of an electrified projectile), by deployment mechanisms, and/or by gravity. For example, system 100 of FIGS. 1-4 includes launch device 102 and cartridge 104. Cartridge 104 includes one or more projectiles 132, each having a waveform generator 136.

Launch device 102 includes power supply 112, aiming apparatus 114, propulsion apparatus 116, and waveform controller 122. Propulsion apparatus 116 includes propulsion activator 118 and propellant 120. In an alternate implementation, propellant 120 is part of cartridge 104. Waveform controller 122 may be omitted with commensurate simplification of waveform generator 136, discussed below.

Any conventional materials and technology may be employed in the manufacture and operation of launch device 102. For example, power supply 112 may include one or more rechargeable batteries, aiming apparatus 114 may include a laser gun sight, propulsion activator 118 may include a mechanical trigger similar in some respects to the trigger of a hand gun, and propellant 120 may include compressed nitrogen gas. In one implementation, launch device is handheld and operable in a manner similar to a conventional hand gun. In operation, cartridge 104 is mounted on or in launch device 102, manual operation by the user causes the projectile bearing electrodes to be propelled away from launch device 102 and toward a target (e.g., an animal such as a human), and after the electrodes become electrically coupled to the target, a stimulus signal is delivered through a portion of the tissue of the target.

Projectile 132 may be tethered to launch device 102 and suitable circuitry in launch device 102 (not shown) using any conventional technology for purposes of providing substitute or auxiliary power to power source 134; triggering, retriggering, or controlling waveform generator 136; activating, reactivating, or controlling deployment; and/or receiving signals at launch device 102 provided from electrodes 142 in cooperation with instrumentation in projectile 132 (not shown).

A waveform controller includes a wireless communication interface and a user interface. The communication interface may include a radio or an infrared transceiver. The user interface may include a keypad and flat panel display. For example, waveform controller 122 forms and maintains a link by radio communication with waveform generator 136 for control and telemetry using conventional signaling and data communication protocols. Waveform controller 122 includes an operator interface capable of displaying status to the user of system 100 and capable of issuing controls (e.g., commands, messages, or signals) to waveform generator 136 automatically or as desired by the user. Controls serve to control any aspect and/or collect data from any circuit of projectile 132. Controls may affect time and amplitude characteristics of the stimulus signal including overall start, restart, and stop functions. Telemetry may include feedback control of any function of waveform generator 136 or other instrumentation in projectile 132 implemented with conventional technology (not shown). Status may include any characteristics of the stimulus signal and stimulus signal delivery circuit.

Cartridge 104 includes projectile 132 having power source 134, waveform generator 136, and electrode deployment apparatus 138. Electrode deployment apparatus 138 includes deployment activator 140 and one or more electrodes 142. Power source 134 may include any conventional battery selected for relatively high energy output to volume ratio. Waveform generator 136 receives power from power source 134 and generates a stimulus signal according to various aspects of the present invention. The stimulus signal is delivered into a circuit that is completed by a path through the target via electrodes 142. Power source 134, waveform generator 136, and electrodes 142 cooperate to form a stimulus signal delivery circuit that may further include one or more additional electrodes not deployed by deployment activator 142 (e.g., placed by impact of projectile 132).

Projectile 132 may include a body having compartments or other structures for mounting power source 134, a circuit assembly for waveform generator 136, and electrode deployment apparatus 138. The body may be formed in a conventional shape for ballistics (e.g., a wetted aerodynamic form).

An electrode deployment apparatus includes any mechanism that moves electrodes from a stowed configuration to a deployed configuration. For example, in an implementation where electrodes 142 are part of a projectile propelled through the atmosphere to the target, a stowed configuration provides aerodynamic stability for accurate travel of the projectile. A deployed configuration completes a stimulus signal delivery circuit directly via impaling the tissue or indirectly via an arc into the tissue. A separation of about 7 inches has been found to be more effective than a separation of about 1.5 inches; and, longer separations may also be suitable such as an electrode in the thigh and another in the hand. When the electrodes are further apart, the stimulus signal apparently passes through more tissue, creating more effective stimulation.

According to various aspects of the present invention, deployment of electrodes is activated after contact is made by projectile 132 and the target. Contact may be determined by a change in orientation of the deployment activator; a change in position of the deployment activator with respect to the projectile body; a change in direction, velocity, or acceleration of the deployment activator; and/or a change in conductivity between electrodes (e.g., 142 or electrodes placed by impact of projectile 132 and the target). A deployment activator 140 that detects impact by mechanical characteristics and deploys electrodes by the release or redirection of mechanical energy is preferred for low cost projectiles.

Deployment of electrodes, according to various aspects of the present invention, may be facilitated by behavior of the target. For example, one or more closely spaced electrodes at the front of the projectile may attach to a target to excite a painful reaction in the target. One or more electrodes may be exposed and suitably directed (e.g., away from the target). Exposure may be either during flight or after impact. Pain in the target may be caused by the barb of the electrode stuck into the target's flesh or, if there are two closely space electrodes, delivery of a stimulus signal between the closely spaced electrodes. While these electrodes may be too close together for suitable immobilization, the stimulus signal may create sufficient pain and disorientation. A typical response behavior to pain is to grab at the perceived cause of pain with the hands (or mouth, in the case of an animal) in an attempt to remove the electrodes. This so called "hand trap" approach uses this typical response behavior to implant the one or more exposed electrodes into the hand (or mouth) of the target. By grabbing at the projectile, the one or more exposed electrodes impale the target's hand (or mouth). The exposed electrodes in the hand (or mouth) of the target are generally well spaced apart from other electrodes so that stimulation between another electrode and an exposed electrode may allow suitable immobilization.

In an alternate system implementation, launch device 102, cartridge 104, and projectile 132 are omitted; and power source 134, waveform generator 136, and electrode deployment apparatus 138 are formed as an immobilization device 150 adapted for other conventional forms of placement on or in the vicinity of the target. In another alternate implementation, deployment apparatus 138 is omitted and electrodes 142 are placed by target behavior and/or gravity. Immobilization device 150 may be packaged using conventional technology for personal security (e.g., planting in a human target's clothing or in an animal's hide for future activation), facility security (e.g., providing time for surveillance cameras, equipment shutdown, or emergency response), or military purposes (e.g., land mine).

Projectile 132 may be lethal or non-lethal. In alternate implementations, projectile 132 includes any conventional technology for administering deadly force.

Immobilization as discussed herein includes any restraint of voluntary motion by the target. For example, immobilization may include causing pain or interfering with normal muscle function. Immobilization need not include all motion or all muscles of the target. Preferably, involuntary muscle functions (e.g., for circulation and respiration) are not disturbed. In variations where placement of electrodes is regional, loss of function of one or more skeletal muscles accomplishes suitable immobilization. In another implementation, suitable intensity of pain is caused to upset the target's ability to complete a motor task, thereby incapacitating and disabling the target.

Alternate implementations of launch device 102 may include or substitute conventionally available weapons (e.g., firearms, grenade launchers, vehicle mounted artillery). Projectile 132 may be delivered via an explosive charge 120 (e.g., gunpowder, black powder). Projectile 132 may alternatively be propelled via a discharge of compressed gas (e.g., nitrogen or carbon dioxide) and/or a rapid release of pressure (e.g., spring force, or force created by a chemical reaction such as a reaction of the type used in automobile air-bag deployment).

A waveform generator, according to various aspects of the present invention, may, in any order perform one or more of the following operations: select electrodes for use in a stimulus signal delivery circuit, ionize air in a gap between the electrode and the target, provide an initial stimulus signal, provide alternate stimulus signals, and respond to operator input to control any of the aforementioned operations. In one implementation, a large portion of these operations are controlled by firmware performed by a processor to permit miniaturization of the waveform generator, reduce costs, and improve reliability. For example, waveform generator 200 of FIG. 2 may be used as waveform generator 136 discussed above. Waveform generator 200 includes low voltage power supply 204, high voltage power supply 206, switches 208, processor circuit 220, and transceiver 240.

The low voltage power supply receives a DC voltage from power source 134 and provides other DC voltages for operation of waveform generator 200. For example, low voltage power supply 204 may include a conventional switching power supply circuit (e.g., LTC3401 marketed by Linear Technology) to receive 1.5 volts from a battery of source 134 and supply 5 volts and 3.3 volts DC.

The high voltage power supply receives an unregulated DC voltage from a low voltage power supply and provides a pulsed, relatively high voltage waveform as stimulus signal VP. For example, high voltage power supply 206 includes switching power supply 232, transformer 234, rectifier 236, and storage capacitor C12 all of conventional technology. In one implementation, switching power supply 232 comprising a conventional circuit (e.g., LTC1871 marketed by Linear Technology) receives 5 volts DC from low voltage power supply 204 and provides a relatively low AC voltage for transformer 234. A feedback control signal into switching power supply 232 assures that the peak voltage of signal VP does not exceed a limit (e.g., 500 volts). Transformer 234 steps up the relatively low AC voltage on its primary winding to a relatively high AC voltage on each of two secondary windings (e.g., 500 volts). Rectifier 236 provides DC current for charging capacitor C12.

Switches 208 form stimulus signal VP across electrode(s) by conducting for a brief period of time to form each pulse; followed by opening. The discharge voltage available from capacitor C12 decreases during the pulse duration. When switches 208 are open, capacitor C12 may be recharged to provide the same discharge voltage for each pulse.

Processor circuit 220 includes a conventional programmable controller circuit having a microprocessor, memory, and analog to digital converter programmed according to various aspects of the present invention, to perform methods discussed below.

A projectile-based transceiver communicates with a waveform controller as discussed above. For example, transceiver 240 includes a radio frequency (e.g., about 450 MHz) transmitter and receiver adapted for data communication between projectile 132 and launch device 102 at any time. A communication link between 136 and 122 may be established in any suitable configuration of projectile 132 depending for example on placement and design of radiators and pickups suitable for the communication link (e.g., antennas or infrared devices). In one implementation projectile 132 operates in four configurations: (1) a stowed configuration, where aerodynamic fins and deployable electrodes are in storage locations and orientations; (2) an in flight configuration, where aerodynamic fins are in position extended away from projectile 132; (3) an impact configuration after contact with the target; and (4) an electrode deployed configuration.

A stimulus signal includes any signal delivered via electrodes to establish or maintain a stimulus signal delivery circuit through the target, and/or to immobilize the target. According to various aspects of the present invention, these purposes are accomplished with a signal having a plurality of stages. Each stage comprises a period of time during which one or more waveforms are consecutively delivered via a waveform generator and electrodes coupled to the waveform generator. Stages from which a complete waveform, according to various aspects of the present invention may be constructed include in any order: (a) a path formation stage for ionizing an air gap that may be in series with the electrode to the targets tissue; (b) a path testing stage for measuring an electrical characteristic of the stimulus signal delivery circuit (e.g., whether or not an air gap exists in series with the target's tissue); (c) a strike stage for immobilizing the target; (d) a hold stage for discouraging further motion by the target; and (e) a rest stage for permitting limited mobility by the target (e.g., to allow the target to catch a breath).

An example of signal characteristics for each stage is described in FIG. 3. In FIG. 3, two stages of a stimulus signal are attributed to path management and three stages are attributed to target management. The waveform shape of each stage may have positive amplitude (as shown), inverse amplitude, or alternate between positive and inverse amplitudes in repetitions of the same stage. Path management stages include a path formation stage and a path testing stage as discussed above.

In the path formation stage, a waveform shape may include an initial peak (voltage or current), subsequent lesser peaks alternating in polarity, and a decaying amplitude tail. The initial peak voltage may exceed the ionization potential for an air gap of expected length (e.g., about 50 Kvolts, preferably about 10 Kvolts). In one implementation, the waveform shape is formed as a decaying oscillation from a conventional resonant circuit. One waveform shape having one or more peaks may be sufficient to ionize a path crossing a gap (e.g., air). Repetition of applying such a waveform shape may follow a path testing stage (or monitoring concurrent with another stage) that concludes that ionization is needed and is to be attempted again (e.g., prior attempt failed, or ionized air is disrupted).

In a path testing stage, a voltage waveform is sourced and impressed across a pair of electrodes to determine whether the path has one or more electrical characteristics sufficient for entry into a path formation, strike, or hold stage. Path impedance may be determined by any conventional technique, for instance, monitoring an initial voltage and a final voltage across a capacitor that is coupled for a predetermined period of time to supply current into electrodes. In one implementation, the shape of the voltage pulse is substantially rectangular having a peak amplitude of about 450 volts, and having a duration of about 10 microseconds. A path may be tested several times in succession to form an average test result, for instance from one to three voltage pulses, as discussed above. Testing of all combinations of electrodes may be accomplished in about one millisecond. Results of path testing may be used to select a pair of electrodes to use for a subsequent path formation, strike, or hold stage. Selection may be made without completing tests on all possible pairs of electrodes, for instance, when electrode pairs are tested in a sequence from most preferred to least preferred.

In a strike stage, a voltage waveform is sourced and impressed across a pair of electrodes. Typically this waveform is sufficient to interfere with voluntary control of the target's skeletal muscles, particularly the muscles of the thighs and/or calves. In another implementation, use of the hands, feet, legs and arms are included in the effected immobilization. The pair may be as selected during a test stage; or as prepared for conduction by a path formation stage. According to various aspects of the present invention, the shape of the waveform used in a strike stage includes a pulse with decreasing amplitude (e.g., a trapezoid shape). In one implementation, the shape of the waveform is generated from a capacitor discharge between an initial voltage and a termination voltage.

The initial voltage ma be a relatively high voltage for paths that include ionization to be maintained or a relatively low voltage for paths that do not include ionization. The initial voltage may correspond to a stimulus peak voltage (SPV) as in FIG. 3 The SPV may be essentially the initial voltage for a fast rise time waveform. The SPV following ionization may be from about 3 Kvolts to about 6 Kvolts, preferably about 5 Kvolts. The SPV without ionization may be from about 100 to about 600 volts, preferably from about 350 volts to about 500 volts, most preferably about 400 volts. The initial voltage may correspond to a skeletal muscle nerve action potential.

The termination voltage may be determined to deliver a predetermined charge per pulse. Charge per pulse minimum may be designed to assure continuous muscle contraction as opposed to discontinuous muscle twitches. Continuous muscle contraction has been observed in human targets where charge per pulse is above about 15 microcoulombs. A minimum of about 50 microcoulombs is used in one implementation. A minimum of 85 microcoulombs is preferred, though higher energy expenditure accompanies the higher minimum charge per pulse.

Charge per pulse maximum may be determined to avoid cardiac fibrillation in the target. For human targets, fibrillation has been observed at 1355 microcoulombs per pulse and higher. The value 1355 is an average observed over a relatively wide range of pulse repetition rates (e.g., from about 5 to 50 pulses per second), over a relatively wide range of pulse durations consistent with variation in resistance of the target (e.g., from about 10 to about 1000 microseconds), and over a relatively wide range of peak voltages per pulse (e.g., from about 50 to about 1000 volts). A maximum of 500 microcoulombs significantly reduces the risk of fibrillation while a lower maximum (e.g., about 100 microcoulombs) is preferred to conserve energy expenditure.

Pulse duration is preferably dictated by delivery of charge as discussed above. Pulse duration according to various aspects of the present invention is generally longer than conventional systems that use peak pulse voltages higher than the ionization potential of air. Pulse duration may be in the range from about 20 to about 500 microseconds, preferably in the range from about 30 to about 200 microseconds, and most preferably in the range from about 30 to about 100 microseconds.

By conserving energy expenditure per pulse, longer durations of immobilization may be effected and smaller, lighter power sources may be used (e.g., in a projectile comprising a battery). In one implementation, a AAAA size battery is included in a projectile to deliver about 1 watt of power during target management which may extend to about 10 minutes. In such an embodiment, a suitable range of charge per pulse may be from about 50 to about 150 microcoulombs.

Initial and termination voltages may be designed to deliver the charge per pulse in a pulse having a duration in a range from about 30 microseconds to about 210 microseconds (e.g., for about 50 to 100 microcoulombs). A discharge duration sufficient to deliver a suitable charge per pulse depends in part on resistance between electrodes at the target. For example, a one RC time constant discharge of about 100 microseconds may correspond to a capacitance of about 1.75 microfarads and a resistance of about 60 ohms. An initial voltage of 100 volts discharged to 50 volts may provide 87.5 microcoulombs from the 1.75 microfarad capacitor.

A termination voltage may be calculated to ensure delivery of a predetermined charge. For example, an initial value may be observed corresponding to the voltage across a capacitor. As the capacitor discharges delivering charge into the target, the observed value may decrease. A termination value may be calculated based on the initial value and the desired charge to be delivered per pulse. While discharging, the value may be monitored. When the termination value is observed, further discharging may be limited (or discontinued) in any conventional manner. In an alternate implementation, delivered current is integrated to provide a measure of charge delivered. The monitored measurement reaching a limit value may be used to limit (or discontinue) further delivery of charge.

Pulse durations in alternate implementations may be considerably longer than 100 microseconds, for example, up to 1000 microseconds. Longer pulse durations increase a risk of cardiac fibrillation. In one implementation, consecutive strike pulses alternate in polarity to dissipate charge which may collect in the target to adversely affect the target's heart.

During the strike stage, pulses are delivered at a rate of about 5 to about 50 pulses per second, preferably about 20 pulses per second. The strike stage continues from the rising edge of the first pulse to the falling edge of the last pulse of the stage for from 1 to 5 seconds, preferably about 2 seconds.

In a hold stage, a voltage waveform is sourced and impressed across a pair of electrodes. Typically this waveform is sufficient to discourage mobility and/or continue immobilization to an extent somewhat less than the strike stage. A hold stage generally demands less power than a strike stage. Use of hold stages intermixed between strike stages permit the immobilization effect to continue as a fixed power source is depleted (e.g., battery power) for a time longer than if the strike stage were continued without hold stages. The stimulus signal of a hold stage may primarily interfere with voluntary control of the target's skeletal muscles as discussed above or primarily cause pain and/or disorientation. The pair of electrodes may be the same or different than used in a preceding path formation, path testing, or strike stage, preferably the same as an immediately preceding strike stage. According to various aspects of the present invention, the shape of the waveform used in a hold stage includes a pulse with decreasing amplitude (e.g., a trapezoid shape) and initial voltage (SPV) as discussed above with reference to the strike stage. The termination voltage may be determined to deliver a predetermined charge per pulse less than the pulse used in the strike stage (e.g., from 30 to 100 microcoulombs). During the hold stage, pulses may be delivered at a rate of about 5 to 15 pulses per second, preferably about 10 pulses per second. The strike stage continues from the rising edge of the first pulse to the falling edge of the last pulse of the stage for from about 20 to about 40 seconds (e.g., about 28 seconds).

A rest stage is a stage intended to improve the personal safety of the target and/or the operator of the system. In one implementation, the rest stage does not include any stimulus signal. Consequently, use of a rest stage conserves battery power in a manner similar to that discussed above with reference to the hold stage. Safety of a target may be improved by reducing the likelihood that the target enters a relatively high risk physical or emotional condition. High risk physical conditions include risk of loss of involuntary muscle control (e.g., for circulation or respiration), risk of convulsions, spasms, or fits associated with a nervous disorder (e.g., epilepsy, or narcotics overdose). High risk emotional conditions include risk of irrational behavior such as behavior springing from a fear of immediate death or suicidal behavior. Use of a rest stage may reduce a risk of damage to the long term health of the target (e.g., minimize scar tissue formation and/or unwarranted trauma). A rest stage may continue for from 1 to 5 seconds, preferably 2 seconds.

In one implementation, a strike stage is followed by a repeating series of alternating hold stages and rest stages.

In any of the deployed electrode configurations discussed above, the stimulation signal may be switched between various electrodes so that not all electrodes are active at any particular time. Accordingly, a method for applying a stimulus signal to a plurality of electrodes includes, in any order: (a) selecting a pair of electrodes; (b) applying the stimulus signal to the selected pair; (c) monitoring the energy (or charge) delivered into the target; (d) if the delivered energy (or charge) is less than a limit, conclude that at least one of the selected electrodes is not sufficiently coupled to the target to form a stimulus signal delivery circuit; and (e) repeating the selecting, applying, and monitoring until a predetermined total stimulus (energy and/or charge) is delivered. A microprocessor performing such a method may identify suitable electrodes in less than a millisecond such that the time to select the electrodes is not perceived by the target.

Figure 4:
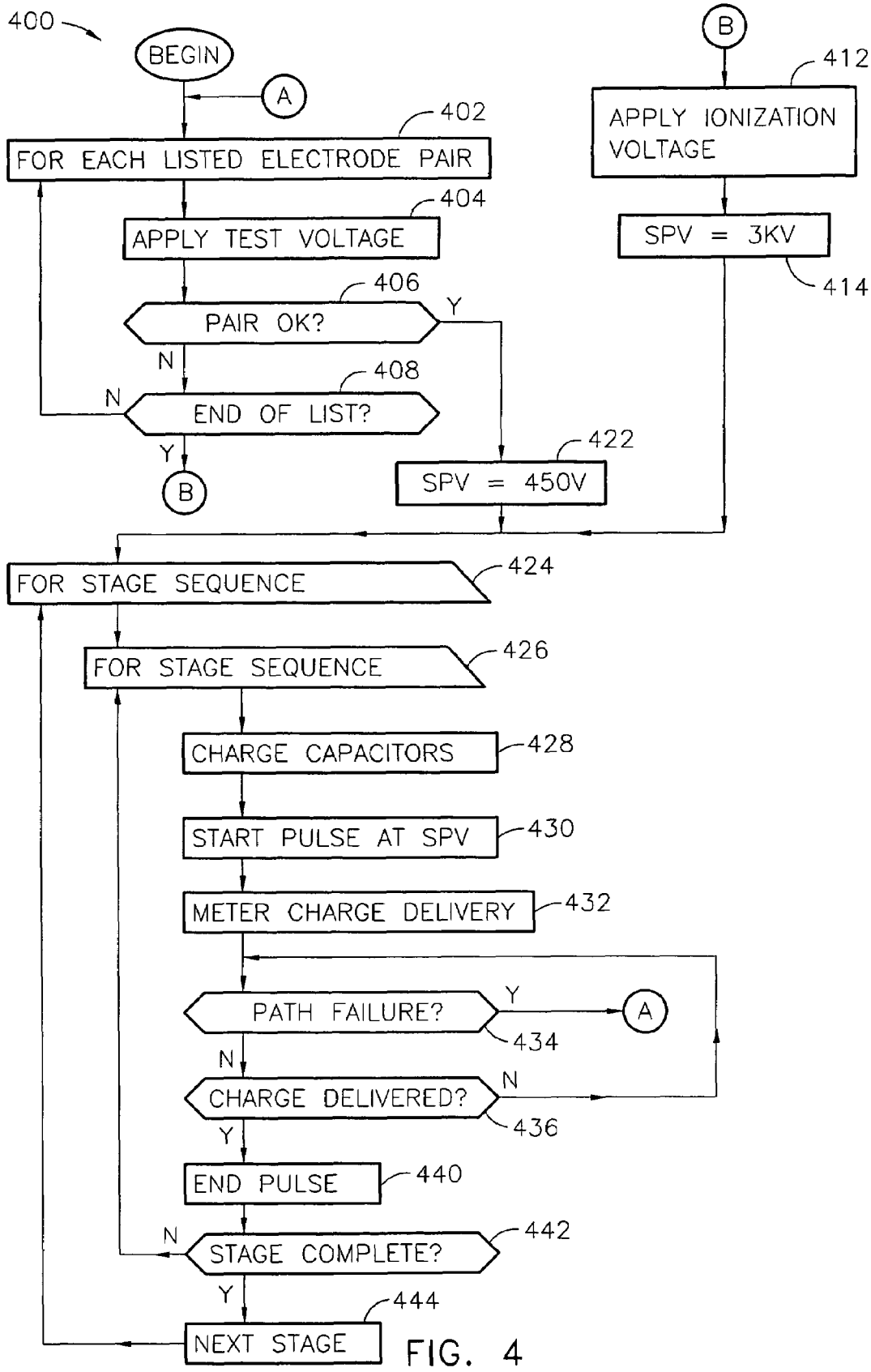
FIG. 4 is a functional flow diagram for a process performed by the immobilization device of FIG. 2.

A waveform generator, according to various aspects of the present invention may perform a method for delivering a stimulus signal that includes selecting a path, preparing the path for the stimulus signal, and repeatedly providing the stimulus signal for a sequence of effects including in any order: a comparatively highly immobilizing effect (e.g., a strike stage as discussed above), a comparatively lower immobilizing effect (e.g., a hold stage as discussed above), and a comparatively lowest immobilizing effect (e.g., a rest stage as discussed above). For example, method 400 of FIG. 4 is implemented as instructions stored in a memory device (e.g., stored and/or conveyed by any conventional disk media and/or semiconductor circuit) and installed to be performed by a processor (e.g., in read only memory of processor circuit 220).

Method 400 begins with a path testing stage as discussed above comprising a loop (402-408) for determining an acceptable or preferred electrode pair. Because the projectile may include numerous electrodes, any subset of electrodes may be selected for application of a stimulus signal. Data stored in a memory accessible to the processor of circuit 220 may include a list of electrode subsets (e.g., pairs), preferably an ordered list from most preferred for maximum immobilization effect to least preferred. In one implementation, the ordered list indicates one preference for one subset of electrodes to be used in all stages discussed above. In another implementation, the list is ordered to convey a preference for a respective electrode subset for each of more than one stage. Method 400 uses one list to express suitable electrode preferences. Alternate implementations include more than one list and/or more than one loop (402-408) (e.g., a list and/or loop for each stage). In another alternate implementation a list includes duplicate entries of the same subset so that the subset is tested before and after intervening test or stimulus signals.

According to method 400, after path management, processor 220 performs target management. Path management may include path formation, as discussed above. Target management may be interrupted to perform path management as discussed below (434). For target management, processor 220 provides the stimulus signal in a sequence of stages as discussed above. In one implementation a sequence of stages is effected by performing a loop (424-444).

For each (424) stage of a predefined stage sequence, a loop (426-442) is performed to provide a suitable stimulus signal. Prior to entry of the inner loop (426-442), a stage is identified. The stage sequence may include one strike stage, followed by alternating hold and rest stages as discussed above.

For the duration of the identified stage (426), processor 220 charges capacitors (428) (e.g., C12 used for signal VP) until charge sufficient for delivery (e.g., 100 microcoulombs) is available or charging is interrupted by a demand to provide a pulse (e.g., operator command via transceiver 240, a result of electrode testing, or lapse of a timer). Processor 220 then forms a pulse (e.g., a strike stage pulse or hold stage pulse) at the value of SPV set as discussed above (422 or 414). Processor 220 meters delivery of charge (432), in one implementation, by observing the voltage (e.g., VC) of the storage capacitors decrease (436) until such voltage is at or beyond a limit voltage (e.g., about 228 volts). The selection of a suitable limit voltage may follow the well known relationship: $\Delta Q = C\Delta V$ where Q is charge in coulombs; C is capacitance in farads; and V is voltage across the capacitor in volts.

During metering of charge delivery, processor 220 may detect (434) that the path in use for the identified stage has failed. On failure, processor 220 quits the identified stage, quits the identified stage sequence, and returns (402) to path testing as discussed above.

When the quantity of charge suitable for the identified stage has been delivered (436), the pulse (e.g., signal VP) is ended (440). The voltage supplied after the pulse is ended may be zero (e.g., open circuit at least one of the identified electrodes) or a nominal voltage (e.g., sufficient to maintain ionization).

If the identified stage is not complete, then processing continues at the top of the inner loop (426). The identified stage may not be complete when a duration of the stage has not lapsed; or a predetermined quantity of pulses has not been delivered. Otherwise, processor 220 identifies (444) the next stage in the sequence of stages and processing continues in the outer loop (424). The outer loop may repeat a stage sequence (as shown) until the power source for waveform generator is fully depleted.

For each (402) listed electrode subset, processor 220 applies (404) a test voltage across an identified electrode subset. In one implementation, processor 220 applies a comparatively low test voltage (e.g., about 500 volts) to determine an impedance of the stimulus signal delivery circuit that includes the identified electrodes. Impedance may be determined by evaluating current, charge, or voltage. For instance, processor 220 may observe a change in voltage of a signal (e.g., VC) corresponding to the voltage across the a capacitor (e.g., C12) used to supply the test voltage. If observed change in voltage (e.g., peak or average absolute value) exceeds a limit, the identified electrodes are deemed suitable and the stimulus peak voltage is set to 450 volts. Otherwise, if not at the end of the list, another subset is identified (408) and the loop continues (402).

In another implementation, processor 220 applies a comparatively low test voltage (e.g., about 500 volts) with delivery of a suitable charge (e.g., from about 20 to about 50 microcoulombs) to attract movement of the target toward an electrode. For example, movement may result in impaling the target's hand on a rear facing electrode thereby establishing a preferred circuit through a relatively long path through the target's tissue. In one implementation, the rear facing electrode is close in proximity to electrodes of the subset and is also a member of the subset. Alternatively, the rear facing electrode may be relatively distant from other electrodes of the set and/or not a member of the subset.

The test signal used in one implementation has a pulse amplitude and a pulse width within the ranges used for stimulus signals discussed herein. One or more pulses constitute a test of one subset. In alternate implementations, the test signal is continuously applied during the test of a subset and test duration for each subset corresponds to the pulse width within the range used for stimulus signals discussed herein.

If at the end of the list no pair is found acceptable, processor 220 identifies a pair of electrodes for a path formation stage as discussed above. Processor 220 applies (412) an ionization voltage to the electrodes in any conventional manner. Presuming ionization occurred, subsequent strike stages and hold stages may use a stimulus peak voltage to maintain ionization. Consequently, SPV is set (414) to 3 Kvolts.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A method, performed by an apparatus, the apparatus for interfering with locomotion of a target by conducting a current through the target, the method comprising:

providing a first pulse of the current, the first pulse having a first voltage;

monitoring the provision of the first pulse; and providing a second pulse of the current, the second pulse having a second voltage, the second voltage responsive to a result of monitoring and sufficient to ionize air in a gap in series with the target.

2. The method of claim 1 wherein monitoring comprises determining whether a charge greater than a threshold amount was output from the apparatus during provision of the first pulse.

3. The method of claim 1 wherein monitoring further comprises determining whether the current was provided into an impedance having a magnitude less than a threshold amount.

4. The method of claim 1 wherein monitoring further comprises determining whether the current accomplished ionization of air in a gap in series with the target.

5. The method of claim 1 wherein:

providing the first pulse comprises storing energy in a capacitance; and monitoring further comprises detecting a decrease in an energy stored in the capacitance.

6. The method of claim 1 wherein providing the first pulse comprises providing the first voltage sufficient to ionize air in a gap in series with the target.

7. The method of claim 1 wherein the first voltage is a peak voltage.

8. A method, performed by an apparatus, the apparatus for interfering with locomotion of a target by conducting a current through the target, the method comprising:

using a first voltage to test whether a path exists, the path having an impedance less than a threshold, the path to provide the current;

if the path exists, providing the current, the current having a second voltage not greater than the first voltage; and otherwise, using a third voltage to provide at least a portion of the current, wherein the third voltage is sufficient to form the path.

9. The method of claim 6 further comprising propelling a plurality of electrodes toward the target, the electrodes at least for testing the existence of the path.

10. The method of claim 6 wherein using is repeated to obtain an average, the average indicating whether the path exists.

11. The method of claim 6 wherein:

the method further comprises storing energy in a capacitance; and using comprises sourcing the first voltage from the energy stored in the capacitance and detecting a decrease in the energy stored in the capacitance.

12. An apparatus for interfering with locomotion of a target by conducting a current through the target, the apparatus comprising:

a circuit that provides the current, the current comprising a path testing stage and a first stage, wherein during the first stage the target's voluntary locomotion is halted as a consequence of contractions of the skeletal muscles of the target responsive to the current; and a processor that controls the circuit, wherein at least a portion of the path testing stage is concurrent with at least a portion of the first stage.

13. The apparatus of claim 12 wherein:

the current further comprises a path formation stage; and at least a portion of the path testing stage is concurrent with at least a portion of the path formation stage.

14. The apparatus of claim 12 wherein:

the current further comprising a second stage;

a first power consumption of the first stage is greater than a second power consumption of the second stage; and at least a portion of the path testing stage is concurrent with at least a portion of the second stage.

15. The apparatus of claim 12 wherein the circuit comprises a capacitance, and the current is responsive to a discharge of the capacitance.

16. The apparatus of claim 12 wherein the circuit provides the current at a voltage in a range of about 100 volts to about 50,000 volts.

17. The apparatus of claim 12 wherein path testing stage has a duration in a range of about 10 microseconds to about 500 microseconds.

18. The apparatus of claim 12 wherein the circuit provides the current comprising a plurality of pulses, wherein each pulse of the plurality of pulses comprises a path testing stage.

19. The apparatus of claim 18 wherein a pulse comprises current of both polarities.

20. The apparatus of claim 12 wherein the processor meters a charge of the current.

21. The apparatus of claim 20 wherein the processor interrupts the first stage in response to determining that the path has failed.

22. The apparatus of claim 20 wherein the charge is in a range of about 50 microcoulombs to about 150 microcoulombs.

23. The apparatus of claim 12 wherein the path testing stage is substantially accomplished at a stimulus peak voltage.

24. The apparatus of claim 23 wherein the stimulus peak voltage is in a range of about 100 volts to about 50,000 volts.

25. The apparatus of claim 12 wherein the path testing stage is substantially accomplished at a first voltage and the first stage is substantially accomplished at a second voltage.

26. The apparatus of claim 25 wherein the first voltage is greater than the second voltage.

27. The apparatus of claim 25 wherein the first voltage is less than the second voltage.

28. A method, performed by an apparatus, the apparatus for interfering with locomotion of a target by conducting a current through the target, the method comprising:

providing a first pulse of the current, the first pulse having a first voltage;

monitoring the provision of the first pulse; and providing a second pulse of the current, the second pulse having a second voltage, the second voltage responsive to a result of monitoring and greater than the first voltage.

29. The method of claim 28 wherein monitoring comprises determining whether a charge greater than a threshold amount was output from the apparatus during provision of the first pulse.

30. The method of claim 28 wherein monitoring further comprises determining whether the current was provided into an impedance having a magnitude less than a threshold amount.

31. The method of claim 28 wherein monitoring further comprises determining whether the current accomplished ionization of air in a gap in series with the target.

32. The method of claim 28 wherein:

providing the first pulse comprises storing energy in a capacitance; and monitoring further comprises detecting a decrease in an energy stored in the capacitance.

* * * * *

UNITED STATES PATENT AND TRADEMARK OFFICE

CERTIFICATE OF CORRECTION

PATENT NO. : 7,280,340 B2
APPLICATION NO. : 10/750374
DATED : October 9, 2007
INVENTOR(S) : Patrick W. Smith et al.

It is certified that error appears in the above-identified patent and that said Letters Patent is hereby corrected as shown below:

In Sheet 3 of 4, column 3, row 4, delete "A=450KV" and insert -- "A=450 V" --, therefor.

In column 8, line 40, delete "ma" and insert -- may --, therefor.

In column 8, line 44, delete "FIG. 3" and insert -- FIG. 3. --, therefor.

Signed and Sealed this
Twenty-second Day of November, 2011

David J. Kappos

David J. Kappos
*Director of the United States Patent and Trademark Office*